US007806614B2

(12) United States Patent
Desson et al.

(10) Patent No.: US 7,806,614 B2
(45) Date of Patent: Oct. 5, 2010

(54) MULTIPLE FOUNDATION STICK CONTAINER

(75) Inventors: G. Scott Desson, Long Valley, NJ (US); Dennis J. Anderson, Randolph, NJ (US)

(73) Assignee: HCT Limited, Hong Kong (CN)

( * ) Notice: Subject to any disclaimer, the term of this patent is extended or adjusted under 35 U.S.C. 154(b) by 1056 days.

(21) Appl. No.: 11/503,363

(22) Filed: Aug. 11, 2006

(65) Prior Publication Data

US 2008/0038041 A1 Feb. 14, 2008

(51) Int. Cl.

| | |
|---|---|
| ***B43K 21/16*** | (2006.01) |
| ***B43K 27/02*** | (2006.01) |
| ***B43K 27/00*** | (2006.01) |
| ***B43K 21/00*** | (2006.01) |
| ***B43K 5/06*** | (2006.01) |
| ***A45D 40/02*** | (2006.01) |
| ***A45D 40/06*** | (2006.01) |

(52) U.S. Cl. ..... 401/65; 401/19; 401/31; 401/84; 401/86; 401/87; 401/179

(58) Field of Classification Search ..... 401/17, 401/19, 29, 31, 52, 53, 66, 78, 84, 179, 74, 401/80, 55, 65, 82, 86, 87
See application file for complete search history.

(56) References Cited

U.S. PATENT DOCUMENTS

| | | | | |
|---|---|---|---|---|
| 1,482,407 A | | 2/1924 | Pennock | |
| 1,623,509 A | | 4/1927 | Vivaudou | |
| 2,159,872 A | * | 5/1939 | Younghusband | 401/78 |
| 2,171,794 A | | 9/1939 | Jones | |
| 2,491,980 A | | 12/1949 | Hines | |
| 2,523,683 A | | 9/1950 | De Mario | |
| 2,609,922 A | | 9/1952 | Book, Jr. | |
| 2,628,624 A | | 2/1953 | De Mario | |
| 2,825,085 A | | 3/1958 | Ingraham | |
| 3,728,034 A | | 4/1973 | Winter | |
| 5,302,042 A | * | 4/1994 | Ackermann | 401/74 |
| 5,746,530 A | * | 5/1998 | Oota | 401/88 |
| 6,089,774 A | * | 7/2000 | Franken et al. | 401/63 |
| D441,145 S | | 4/2001 | Chang | |
| D450,159 S | | 11/2001 | Chang | |
| 2002/0067947 A1 | * | 6/2002 | Liu | 401/66 |

FOREIGN PATENT DOCUMENTS

EP 1535532 A1 * 6/2005

* cited by examiner

*Primary Examiner*—Gregory L Huson
*Assistant Examiner*—Ryan A Varnum
(74) *Attorney, Agent, or Firm*—Norris McLaughlin & Marcus, P.A.

(57) ABSTRACT

A container used for holding one or more product sticks. The container comprises a body and a sleeve. The container further comprises lifting means to independently propel and retract the product sticks. The container may further comprise a cover which engages the body.

17 Claims, 4 Drawing Sheets

MULTIPLE FOUNDATION STICK CONTAINER

BACKGROUND OF THE INVENTION

1. Field of the Invention

The invention pertains to a container for holding more than one material. The container comprises an outer body with a sleeve having one or more, such as two or more, compartments therein. Each of the compartments houses a lifting means to propel the material independently out of the sleeve. The container may further comprise a cover which engages the body to protect the material from the external environment.

2. The Related Art

Containers for holding multiple cosmetic sticks have been described in the art. These containers described in the art, however, are push-up type containers. The invention comprises lifting means which facilitates movement of material, such as a product stick for use on or about the lips, eyes, face or body out of and back into the container. With the container of the invention, the consumer is not required to engage in the cumbersome act of moving or sliding a mechanism along the side of a container in order to propel and retract material out of and into the container.

SUMMARY OF THE INVENTION

The invention pertains to a container that can house more than one material, like a product stick, such as a product stick for use on or about the lips, eyes, face or body. The container comprises a body with an upper end having a rim which defines an upper opening at the upper end and a lower end having a bottom which has a bottom inner surface and a bottom outer surface. The body comprises a side wall which extends from the upper opening to the bottom having a side wall inner surface and a side wall outer surface. The side wall comprises one or more wheel slots, such as two or more, extending from the side wall outer surface to the side wall inner surface generally about perpendicular to the upper opening and bottom. The wheel slots are defined by wheel slot walls. The side wall inner surface and bottom inner surface define a body annular space which is open at the top at the upper opening.

The body may further comprise one or more, such as two or more, sets of guides at the side wall inner surface. Each set of guides comprises a first guide wall and second guide wall, with each guide wall having an inner surface and an outer surface. The top of each guide wall comprises a means for holding a wheel. The sets of guides are proximate to the wheel slots such that the wheel is held by the means for holding the wheel with the wheel protruding at least partially from the wheel slot and thus extending from the outer surface of the side wall of the body so that a consumer may rotate the wheel in both a forward and reverse direction to, as explained below, propel the material from the container and retract the material back into the container.

The container further comprises a sleeve having a sleeve top, a sleeve bottom, a sleeve side wall having sleeve inner surface and a sleeve outer surface. The sleeve has an internal annular space defined by the sleeve inner surface with the sleeve being generally open at the top and bottom. The sleeve may be inserted into the body annular space such that the sleeve outer surface is juxtaposed with the side wall inner surface of the body, with the sleeve bottom adjacent to the bottom of the body. The sleeve may further comprise one or more, such as two or more, sleeve slots which extend from the bottom of the sleeve to a point between the top and bottom of the sleeve. Each sleeve slot is defined by a sleeve slot first wall, sleeve slot second wall and sleeve slot top wall within the sleeve side wall. The sleeve is generally within the body such that each sleeve slot is adjacent to a set of guides with the outer surfaces of the first guide wall and second guide wall juxtaposed with the sleeve slot first wall and sleeve slot second wall. This arrangement provides each wheel with access to the internal annular space of the sleeve to, as discussed above, interact with the lifting means. The internal annular space of the sleeve may be divided into sections by one or more dividing walls.

The container also comprises one or more, such as two or more, lifting means to propel the material out of the sleeve and retract the material back into the sleeve after use. The lifting means may be any device that can hold cosmetic material, such as a cosmetic stick, and responds to a force to propel the cosmetic stick out of the container. For example, the means may be a button with a platform that moves in response to a force applied to the button to slide the platform within the container, in particular the body and/or inner annular space of the sleeve. Another example is one or more elevator platforms within the sleeve annular space with each elevator platform having one or more slots with teeth members that interact with one or more wheels such as engaging gears of the wheels. The engaging gears have teeth which interact with the teeth elements of the elevator platform slots. When the wheel is moved in one direction, the teeth of the engaging members are caused to move against the teeth elements in the slots which cause the elevator platform to independently move in one direction, such as upwards and out of the sleeve and/or body. When the wheel is turned in the opposite direction, the platform is caused to move in the opposite direction, such as downwards thereby retracting back into the sleeve and/or body. Thus, the wheels function as part of the lifting means to propel the material for use and retract the material for storage.

The container further comprises a cover which generally engages the body. The cover comprises a cover top having a cover top outer surface and a cover top inner surface, a cover side wall having a cover side wall inner surface and cover side wall outer surface and a bottom having a bottom opening defined by the cover side wall inner surface at the bottom. The container may further comprise means for releasably securing the cover to the body, such as friction fit between the body and cover, protrusions and/or dimples on the cover and/or bottom, mating screw threads on the body and cover, latches, hinges or the like.

DETAILED DESCRIPTION OF THE DRAWINGS

DETAILED DESCRIPTION OF THE INVENTION

The drawings illustrate a preferred embodiment of the invention. In the preferred embodiment of the invention, the container may comprise or be used to hold more than one product stick, such as 2 or more product sticks, like 2, 3, 4, 5, 6, 7, 8, 9, 10 or more product sticks. Product sticks, include cosmetic sticks, like lipstick and lip balm.

Figure 1:
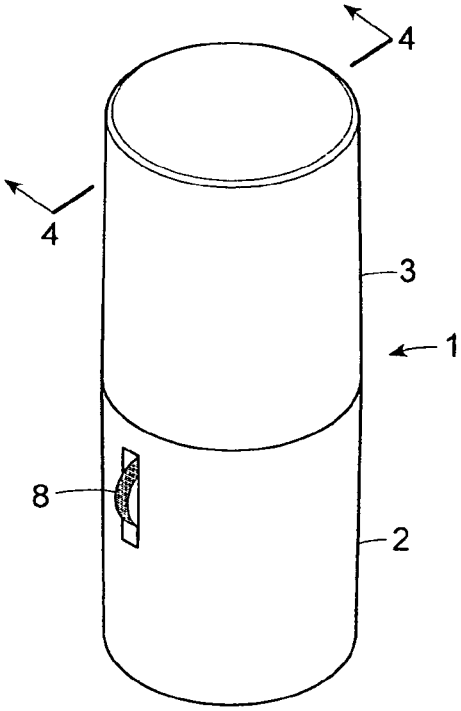
FIG. 1 is a perspective view of a container in accordance with an embodiment of the invention.
Figure 2A:
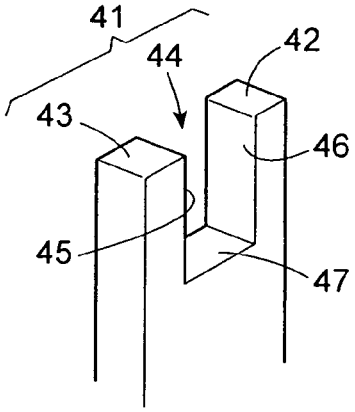
FIG. 2A is a cut-away view of FIG. 2 which shows a means for holding a wheel in accordance with an embodiment of the invention.
Figure 2:
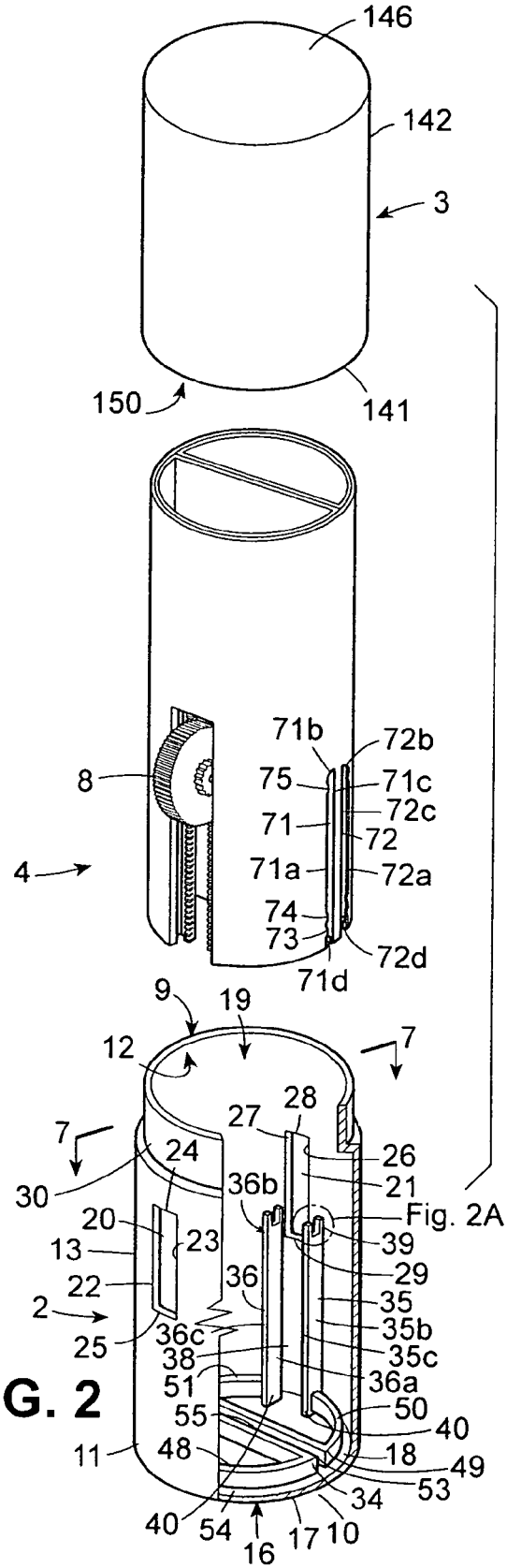
FIG. 2 is an exploded view of a container in accordance with an embodiment of the invention.
Figure 3:
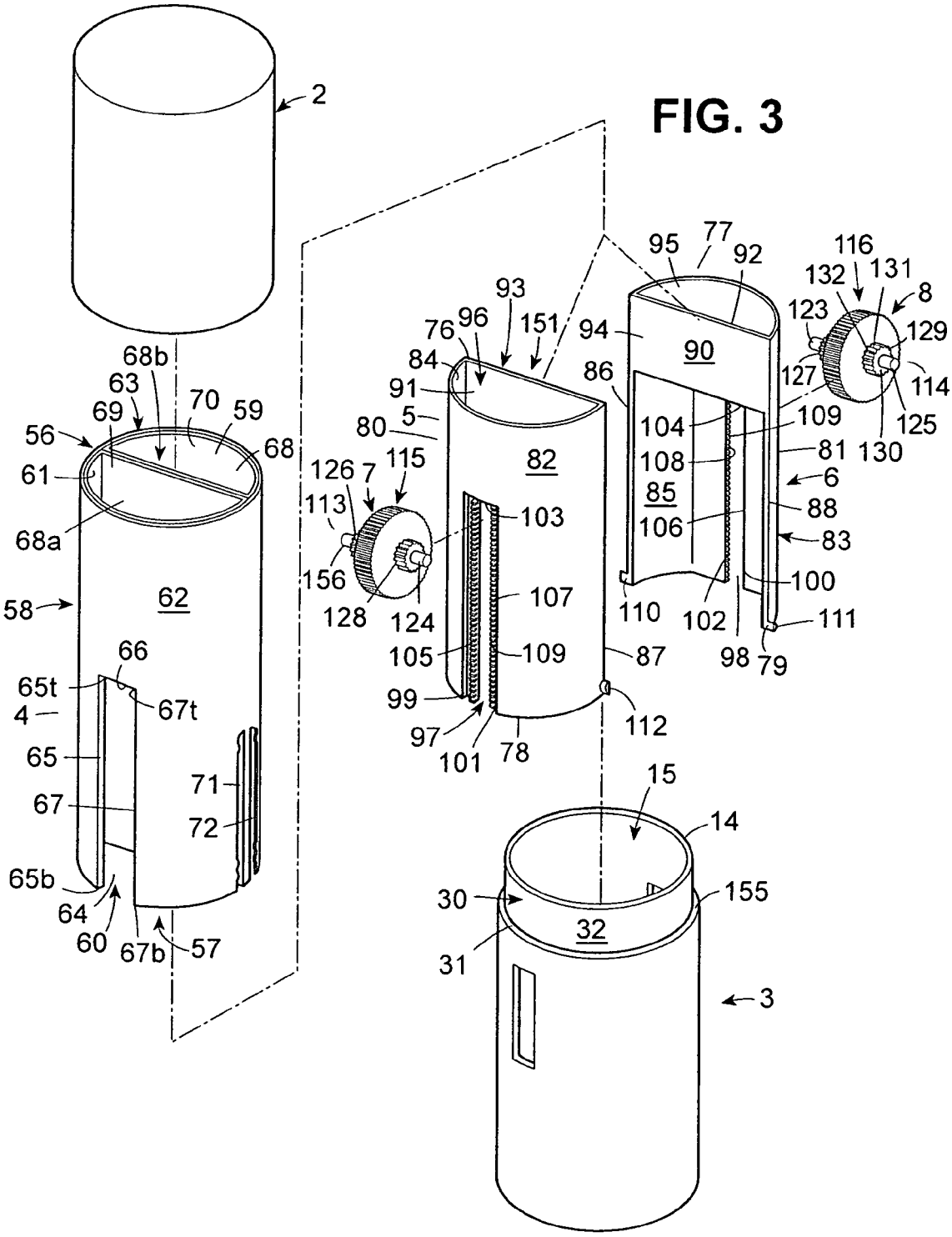
FIG. 3 is an exploded view of a container showing detail of a lifting means in accordance with an embodiment of the invention.

Referring to FIGS. 1-3, the container 1 comprises a body 2 and a cover 3. The container further comprises a sleeve 4 and lifting means, which may comprise at least two elevator platforms, a first elevator platform 5 and a second elevator platform 6 and at least two wheels, a first wheel 7 and a second wheel 8. The individual features of the components of the invention shall now be described in detail below.

As shown in the drawings, the body 2 comprises an upper end 9, a lower end 10 and a side wall 11, i.e. a continuous surface, there between. As shown in the drawings, particularly FIGS. 2 and 3, the side wall extends from the upper end 9 to the lower end 10 and has a side wall inner surface 12 and a side wall outer surface 13. In the embodiment of the invention shown in the drawings, the body is cylindrical although other shapes and configurations of the body are within the scope of the invention. As shown particularly in FIGS. 2 and 3, the body has a rim 14 at the upper end 9 which defines an upper opening 15 and further has a bottom 16 at the lower end of the body, which comprises a bottom inner surface 17 and a bottom outer surface 18. The side wall inner surface and bottom inner surface generally define a body annular space 19 which is open at the top at the upper opening 15.

As shown in the drawings, particularly FIGS. 1-3, the body comprises two wheel slots, a first wheel slot 20 and second wheel slot 21, each of which extend from the side wall outer surface to the side wall inner surface generally about perpendicular to the upper opening and bottom. The wheel slots are defined by wheel slot walls. As shown in FIG. 2 for example, the first wheel slot has a first wheel slot left wall 22, a first wheel slot right wall 23, a first wheel slot upper wall 24 and a first wheel slot bottom wall 25. Likewise, the second wheel slot has a second wheel slot left wall 26, a second wheel slot right wall 27, a second wheel slot upper wall 28 and a second wheel slot bottom wall 29. In the embodiment of the invention, as shown in the drawings, for each wheel slot the left and right walls are generally parallel and opposed to each other and the top and bottom walls are generally parallel and opposed to each other with the left and right walls about perpendicular to the top and bottom walls such that the wheel slots are in the shape of a rectangle, although other shapes and configurations are within the scope of the invention. As shown in the drawings, particularly FIGS. 2 and 4-6, the first wheel slot 20 and second wheel slot 21 are mutually opposed to each other along the side wall of the body.

The body may further comprise a collar 30 at the upper end. For example, in the container shown in FIGS. 2 and 3, the collar is a component of the side wall which extends from the rim to a collar lower terminus 31. Generally, the collar has a collar outer surface 32 with the side wall inner surface at the collar 30 functioning as an inner surface of the collar. The outer surface of the collar is indented from the plane of the outer surface of the side wall such that the collar has a collar shelf 155 at the collar lower terminus which extends from the outer surface of the side wall to the collar outer surface at the lower terminus of the collar. The collar shelf is generally perpendicular to the outer surface of the collar and outer surface of the side wall. As shown in the drawings, the collar lower terminus may be proximate to the first wheel well and/or second wheel well, such as being proximate to the top walls of the first wheel slot 20 and second wheel slot 21. The collar accommodates the cover and may be part of or comprise means for releasably securing the cover to the body as discussed below.

The collar 30 is preferably the same shape and configuration as the side wall of the body, such as cylindrical as shown in the drawings. The collar, however, may be any shape or configuration and may not have the same shape and configuration as the side wall of the body. For example, the outer surface of the body may be cylindrical with the collar having a collar outer surface being of any other geometric shape which accommodates a cover having a geometric shape different from the outer surface of the body.

Figure 7:
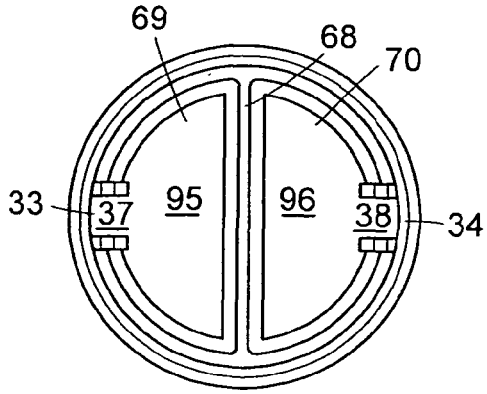
FIG. 7 is a cross section along line 7-7 of FIG. 2 of a container in accordance with an embodiment of the invention.

Referring now to FIGS. 2 and 7, the body 2 further comprises a first set of guides 33 and a second set of guides 34 at the side wall inner surface. The cut-out portion of the body shown in FIG. 2 illustrates the elements of the guides. The first set of the guides and second set of guides each comprise the same elements as the set of guides shown in FIG. 2 each being in the same relative location on the inner surface of the side wall opposite to each other. As such, the first set of guides 33 is proximate to the first wheel slot 20 and the second set of guides 34 is proximate to the second wheel slot 21. Each set of guides comprises a first guide wall 35 and second guide wall 36 that extend from the inner surface of the side wall of the body. Each guide wall has an inner surface (35*a*, 36*a*) an outer surface (35*b*, 36*b*) and an end surface (35*c*, 36*c*) which extends from the inner surface to the outer surface about perpendicular to the inner surface and outer surface, with the inner surface of each guide wall and the inner surface of the side wall between each guide wall defining a guide channel (37, 38). For example, in the embodiment of the invention shown in the drawings, the first set of guide walls has a first guide wall with a first guide wall inner surface, a first guide wall outer surface and a first guide wall end surface and a second guide wall with a second guide wall inner surface, a second guide wall outer surface and a second guide wall end surface; and the second set of guide walls has a first guide wall with a first guide wall inner surface, a first guide wall outer surface and a first guide wall end surface and a second guide wall with a second guide wall outer surface, a second guide wall inner surface and a second guide wall end surface.

Each set of guides comprises a means for holding a wheel. In the embodiment of the invention shown in the drawings, particularly FIGS. 2 and 2A, the means comprises a wheel notch, at the upper end of each guide wall. For example, the first guide wall of each set of guide walls has an apex 39 and a base 40. The base is adjacent to the bottom of the body and the apex is proximate to the wheel slot. The apex has an apex surface 41 which is bifurcated into a distal apex surface 42 proximate to the inner surface of the side wall of the body and a forward apex surface 43 proximate to the guide wall end surface. The notch 44 is between the distal apex surface 42 and forward apex surface 43 and is defined by a forward notch wall 45 which extends about perpendicular from the forward apex surface 43, a distal notch wall 46 which extends about perpendicular from the distal apex surface 42 and a notch base wall 47 which extends from the forward notch wall to the distal notch wall. The notch base wall is about perpendicular to the distal notch wall and forward notch wall. The notch is adjacent to the wheel slot and permits the wheel, or an element of the wheel, to rest within the notch while allowing the wheel full rotational movement. FIG. 2A provides an example of the apex surface 41 which is the same for each guide wall of the container.

The body 2 may further comprise one or more elevator platform stops at the inner surface of the bottom. In the embodiment of the invention shown in the drawings, with particular reference to the cut-away view of the body in FIG. 2, the container comprises two elevator platform stops, a first elevator platform stop 48 and a second elevator platform stop 49. Each elevator platform stop comprises a first crescent element and a second crescent element with a joining member there between. For example, as shown in FIG. 2 the first crescent element 50 extends from the outer surface of the first guide wall to a first end point and the second crescent element 51 extends from the outer surface of the second guide wall to a second end point which is opposite to the first end point. The joining member 53 then extends from the first end point to the second end point. The first crescent element and second crescent element are generally juxtaposed to the inner surface of the side wall of the bottom with a gap 54 which accommodates the sleeve. Each first crescent element, second crescent element and joining member protrudes from the inner surface of the bottom of the body. In the embodiment of the invention shown in FIG. 2, the container has two elevator platform stops which are mutually opposed to each other such that the joining member of the first elevator platform stop is juxtaposed with the joining member of the second elevator platform stop with an optional joining member gap 55 between the joining members of the first elevator platform stop and second elevator platform stop.

The container further comprises one or more sleeves. As shown in the drawings, the container may comprise one sleeve. Referring to FIG. 3, the sleeve 4 has a sleeve top 56, a sleeve bottom 57 and a sleeve side wall 58 which extends from the sleeve top to the sleeve bottom. The sleeve top has a sleeve top opening 59 which is defined by the sleeve side wall 58 at the sleeve top 56 and the sleeve bottom 57 has a sleeve bottom opening 60 which is defined by sleeve side wall 58 at the sleeve bottom 57.

The sleeve side wall 58 comprises a sleeve inner surface 61 and a sleeve outer surface 62. The sleeve inner surface defines a sleeve annular space 63 which extends from the sleeve top 59 to the sleeve bottom 57. In the embodiment of the invention shown in the drawings, the sleeve is cylindrical and in the shape of a tube, however the sleeve may be of any shape or configuration and is generally the same or a similar shape as the body. When the container is assembled the sleeve is inserted into the body annular space 19 such that the sleeve outer surface 62 is juxtaposed with the side wall inner surface 12 of the body 2, with the sleeve bottom 57 adjacent to the bottom 16 of the body 2. In embodiments of the invention, the sleeve bottom 57 may be within the gap 54 at the elevator platform stop.

The sleeve 4, in an embodiment of the invention, comprises two sleeve slots. FIG. 3 shows the sleeve slot 64 on one side of the sleeve, however, the sleeve shown therein has an identical sleeve slot on the sleeve side wall opposite to the sleeve slot shown in FIG. 3. The sleeve slot 64 is defined by a first sleeve slot wall 65, sleeve slot top wall 66 and second sleeve slot wall 67. The first sleeve slot wall 65 and second sleeve slot wall 67 extend from the sleeve bottom 57 to a point on the sleeve side wall 58 between the sleeve bottom 57 and sleeve top 56. For example, the first sleeve slot wall 65 has a first sleeve slot wall bottom 65*b* and a first sleeve slot wall top 65*t* and the second sleeve slot wall 67 has a second sleeve slot wall bottom 67*b* and second sleeve slot wall top 67*t*. The sleeve slot top wall 66 extends from the first sleeve slot wall top 65*t* to the second sleeve slot wall top 67*t*. In the embodiment of the invention shown in the drawings, the sleeve slot top wall is about perpendicular to the first sleeve slot wall and second sleeve slot wall. When the sleeve is assembled into the body, each sleeve slot is adjacent to a set of guides with the outer surfaces of the first guide wall and second guide wall juxtaposed with the first sleeve slot wall and second sleeve slot wall, and it should be understood that although in the embodiment of the invention shown in the drawings, the sleeve has two sleeve slots which correspond to each set of guides in the body as well as the wheel slots on the body, the number of sleeve slots, sets of guides and wheel slots, as well as the number of wheels, elevator platforms and optionally elevator platform stops, correspond to the number of product sticks within the container or the number of product sticks that that container is capable of holding, such as, one but preferably two or more, like 2, 3, 4, 5, 6, 7, 8, 9, 10 or more.

The internal annular space of the sleeve may be divided into sections by one or more dividing walls with the number of sections being equal to the number of product sticks, or the number of product sticks the container is capable of holding, such as one or more preferably two or more like 2, 3, 4, 5, 6, 7, 8, 9, 10 or more, with each section comprising a sleeve slot. In the embodiment of the invention shown in the drawings, for example FIGS. 3 and 6-8, the sleeve comprises one dividing wall 68 which extends from the sleeve top to the sleeve bottom and separates the sleeve into a first sleeve compartment 69 and a second sleeve compartment 70. As shown in the drawings, for example FIGS. 3-4, the dividing wall has a first dividing wall surface 68*a* and a second dividing wall surface 68*b*.

The sleeve 4 may further comprise one or more brake slots and the brake slots will generally correspond in a pattern to each section or compartment of the sleeve. In an embodiment of the invention the sleeve comprises four brake slots, a first brake slot, a second brake slot, a third brake slot and a fourth brake slot. Generally, the first brake slot 71 and second brake slot 72 are paired together on opposite sides of the dividing wall and the third brake slot and fourth brake slot (not shown) are paired with each other on opposite sides of the dividing wall, with the set of first brake slot and second brake slot opposed to the set of third brake slot and fourth brake slot on the sleeve side wall 58. The brake slots are preferably the same and the brake slots shall be described referring to FIGS. 2 and 3 with respect to the first brake slot 71 and second brake slot 72. Each brake slot has a brake slot first side wall (71*a*, 72*a*), a brake slot top (71*b*, 72*b*) a brake slot second side wall (71*c*, 72*c*) and each brake slot further comprises a bottom (71*d*, 72*d*). In the embodiment of the invention shown in the drawings, the brake slot top is upwardly curved. Each first brake slot side wall comprises a brake slot first stop protrusion 73 and a brake slot second stop protrusion 74 proximate to the brake slot bottom and a brake slot third protrusion 75 proximate to brake slot top. When the container is assembled, each brake slot first stop protrusion and brake slot second stop protrusion functions with brakes on the lifting means to transiently hold the lifting means in place when the lifting means is retracted within the sleeve, each brake slot third protrusion functions with brakes on the lifting means to transiently hold the lifting means in place when the lifting means is fully extended from the sleeve in the position where a user is applying the cosmetic stick.

In the embodiment of the invention shown in the drawings, the lifting means comprises one or more elevator platforms. As shown in FIG. 3, the container may comprise two elevator platforms, a first elevator platform 5 and a second elevator platform 6, although any number of elevator platforms, such as 1,2,3,4,5,6,7,8,9,10 or more are within the scope of the invention. The elevator platforms are generally the same in shape and configuration. Referring to FIG. 3, each elevator platform comprises an elevator platform top (76, 77) and an elevator platform bottom (78, 79). Each elevator platform further comprises an external wall (80, 81) having an external wall outer surface (82, 83) and an external wall inner surface (84, 85). The external wall further comprises a forward side wall (86, 87) and a distal side wall (88, and not shown with respect to the first elevator platform 5). The external wall generally extends from the elevator platform top to the elevator platform bottom. Each elevator platform further comprises an internal wall (151, 90) having an internal wall inner surface (91, 92) and an internal wall outer surface (93, 94). The internal wall of each elevator platform extends from the forward side wall (86, 87) of each external wall to the distal side wall (88, 89) of each external wall, and generally extends from the elevator platform top to a point between the elevator platform top but not all the way to the elevator platform bottom. Each elevator platform comprises a cup (95, 96) for holding a product stick, like those discussed above and includes cosmetic sticks like lipstick and lip balm. The cup is defined by the inner surface of the internal wall and at least part of the inner surface of the external wall. The cup may further comprise a cup bottom (not shown) which extends at the bottom of the internal wall from the inner surface of the internal wall to the inner surface of the external wall, and the cup bottom is generally perpendicular to the internal wall and external wall. As shown, for example in FIGS. 4 and 5, the container may be used to hold a first product stick 152 in a first cup 95 of the first elevator platform 5 and a second product stick 153 in a second cup 96 of the second elevator platform 6.

Referring again to FIG. 3, each elevator platform further comprises a platform slot (97, 98) (e.g. the groove) at the external wall which extends from the bottom of the elevator platform to a point between the bottom and top of the elevator platform, but not all the way to the top of the elevator platform. Each platform slot is defined by a platform slot forward edge (99, 100), platform slot distal edge (101, 102) and platform slot top (103, 104), which as shown in the drawings is generally perpendicular to the platform slot forward edge and platform slot distal edge. The platform slot is open at the bottom. The elevator platform further comprises a forward teeth member (105, 106) which extends from the platform slot forward edge partially into the platform slot and a distal teeth member (107, 108) which extends from the platform slot forward edge partially into the platform slot. The forward teeth member and distal teeth member comprise a plurality of teeth (109). The number of elevator platform slots and sets of adjoining forward teeth member of distal teeth member may be equal to the number of product sticks within the container, such as one, or most preferably two or more, like 2,3,4,5,6,7, 8,9,10 or more.

Each elevator platform further comprises one or more brakes at the bottom of the elevator platform. For example, in the embodiment of the invention shown in the FIG. 3, the second elevator platform 77 comprises a forward brake 110 which extends from outer surface of the external wall at the forward side wall 86 proximate to the elevator platform bottom and a distal brake 111 which extends from outer surface of the external wall at the distal side wall 88 proximate to the elevator platform bottom 79. Likewise, the first elevator platform 76 comprises a forward brake 112 which extends from the outer surface of the external wall at the forward side wall 87 proximate to the bottom 78 and a distal brake, which is not shown in FIG. 3, but is identical in shape and configuration as the forward brake but extends from the outer surface of the external wall at the distal side wall 89 proximate to the bottom 78. The brakes interact with the brake stop protrusions such that the forward brake 110 and distal brake 111 of the second elevator platform are inserted into and interact with the second brake slot and fourth brake slot and the forward brake 112 and distal brake of the first elevator platform are inserted into and interact with the third brake slot and function as described above. As should be understood by one skilled in the art, the number of brakes or sets of brakes in the container will correspond to the number of elevator platforms which is proportional to the number of product sticks that the container is capable of holding.

Figure 5:
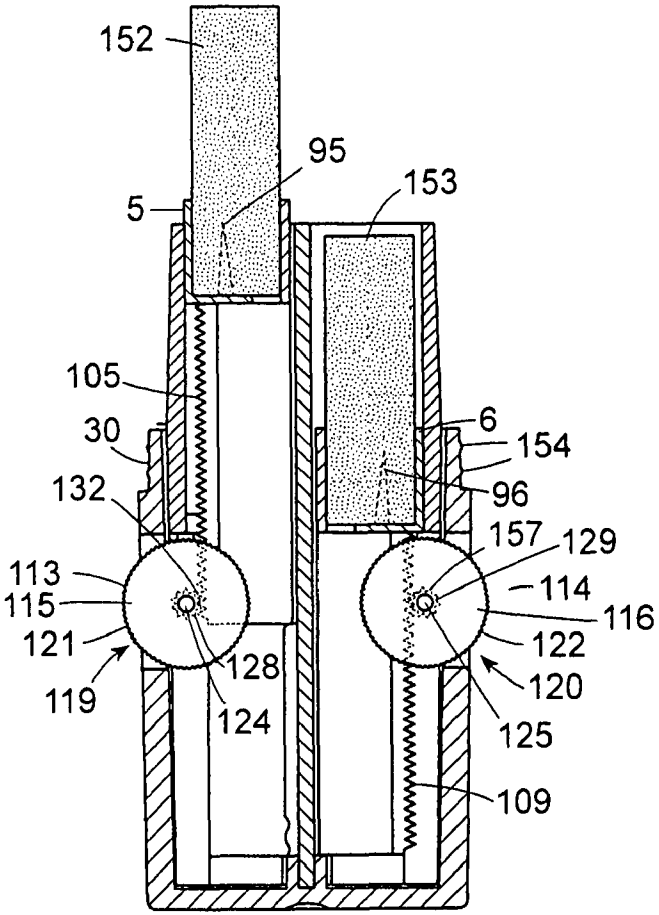
FIG. 5 is a cross section along line 4-4 of FIG. 1 showing the internal features of a container showing one of the product sticks moved into an uppermost position by the lifting means in accordance with an embodiment of the invention.
Figure 8:
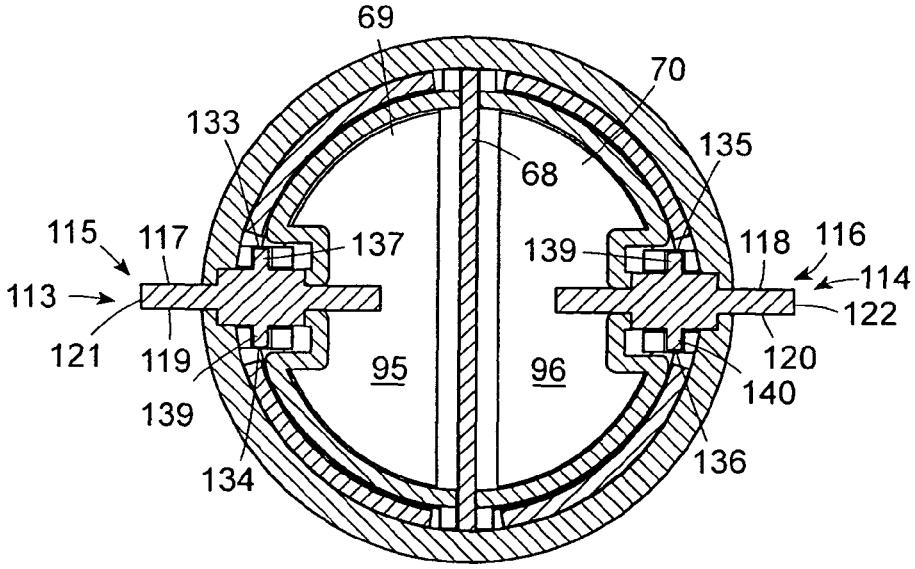
FIG. 8 is a cross section along line 8-8 of FIG. 4 of a container in accordance with an embodiment of the invention.

In the embodiment of the invention shown in the drawings, the lifting means further comprises one or more wheels and as discussed above, the number of wheels generally corresponds to the number of product sticks the container holds or is capable of holding. Referring to FIGS. 3-5 and 8, for example, the lifting means may comprise a first wheel 113 and a second wheel 114. Each wheel comprises a wheel body (115, 116) having a wheel body first surface (117, 118) and a wheel body second surface (119, 120) with a continuous perimeter (121, 122). The continuous perimeter may have a plurality a crevices 121 which establish a roughened surface to facilitate a user moving the wheel to inhibit the finger from sliding off the continuous perimeter when user rotates the wheel around the axle to propel or retract an elevator platform. Each wheel further comprises a first axle (156) and a second axle (124, 125) and a first engaging gear (126, 127) and a second engaging gear (128, 129). Each engaging gear extends laterally from the first surface of the wheel body at about the center of the wheel body. Each engaging gear has an engaging gear outer surface (shown in FIG. 3, for example, with respect to the second engaging gear 129 as 130) and an engaging gear continuous side surface (shown in FIG. 3 as 131 with respect to the second engaging gear 129). Each engaging gear comprises a plurality of engaging gear teeth, as shown in FIG. 5, for example, first engaging gear teeth 132 of the first engaging gear and second engaging gear teeth 157 of the second engaging gear. Each axle, as shown in FIG. 8, extends from an engaging gear outer surface at about the center of the engaging gear outer surface and comprises an axle end (133, 134, 135, 136) and an axle side surface (137, 138, 139, 140), with the first axle being in the shape of a cylinder. In an embodiment of the invention, the axles rest within the notches of the means for holding the wheel.

FIG. 3 demonstrates the assembly of the various components to form the completed embodiment of the invention shown in the drawing. In the assembled container each elevator platform (5, 6) is within the sleeve 4. For example, in the embodiment of the invention shown in the drawings, the container has a first elevator platform 5 within a first sleeve compartment 69 and a second elevator platform 6 within a second sleeve compartment 70 with the brakes positioned within the various brake slots as discussed above. Each sleeve slot 64 is aligned with a platform slot (97, 98) of an elevator platform such that forward teeth member (105, 106) and distal teeth member (107, 108) of each elevator platform is exposed. As shown in the drawings, particularly in FIGS. 4 and 5, a first wheel 113 is engaged with a forward teeth member and a distal teeth member of the elevator platform with some or all of the wheel body 115 and/or the first engaging gear 126 and second engaging gear 128 protruding outwards from the sleeve slot. When the container is assembled, the first engaging gear teeth are engaged with the forward teeth member and the second engaging gear teeth are engaged with the distal teeth member. Also, the second wheel 114 is engaged with forward teeth member and distal teeth member of the elevator platform with some or all of the wheel body 116 and/or first engaging gear 127 and second engaging gear 128 protruding outward from the sleeve slot. As should be understood from the drawings, each wheel interacts with different sleeve slots and sets of forward teeth member and distal teeth member to move different elevator platforms, for example in the embodiment shown in the drawings on opposite sides of the sleeve, to independently move the first elevator platform and second elevator platform. As shown in FIG. 5, for example, the first engaging gear teeth 132 and second engaging gear teeth 157 interact with the teeth 109 of the forward teeth members and distal teeth members of the platform slot edges.

The elevator platforms may be projected out from the sleeve by a user rotating the wheel body which causes first engaging gear and second engaging gear to rotate in the same direction. The first engaging gear teeth and second engaging gear teeth interact with the forward teeth member and second teeth member of the elevator platform thereby causing the elevator platform to move in response to the rotation of the wheel and propel the elevator platform and product stick. Rotating the wheel in the opposite direction will likewise cause the elevator platform and product stick to move in the opposite direction and retract. In a preferred embodiment of the invention, when a user rotates the wheel with an upward force, the wheel causes an elevator platform to move upwards propelling the product stick upwards for use and when a user rotates the wheel with a downwards force the wheel causes the elevator platform to move downwards retracting the product stick downwards for storage within the container. Each elevator platform within the container can propel or retract its respective product stick independent of another elevator platform in the container. The forward brake and the distal brake slide within their respective brake slots and the brake slots prevent the elevator platforms from being moved completely out of the sleeve, and also prevent the elevator platforms from moving completely out of the container itself. As discussed above, the protrusions on the side walls of the brake slots serve to transiently hold the lifting means, in this case the elevator platform, in place when the elevator platform is fully extended or propelled and when the elevator is fully retracted.

In the assembled container, the sleeve 4, first elevator platform 5 and second elevator platform 6 are within the body annular space 19. In an embodiment of the invention, such as that shown in the drawings, the sleeve 4 and elevator platforms (5, 6) project from the upper opening 15 of the body 3. The sleeve and elevator platforms are oriented within the body annular space with the first wheel slot 20 and second wheel slot 21 aligned with a sleeve slot 64 and platform slot (97, 98) such that each wheel body (115, 116) protrudes through its respective wheel slot to enable a user to engage the wheel to independently move the elevator platforms and, thus, product sticks. In the embodiment of the invention shown in the drawings, for example in FIGS. 4 and 5, the first wheel is within the first wheel slot and the second wheel is within the second wheel slot and each independently moves an elevator platform so that one platform may move without the movement of the other elevator platform.

In the embodiment of the invention shown in the drawings, each wheel is held by the wheel notches in the guide walls of the guides. The first axle and second axle rest within the wheel notches 44 with the wheel body and first engaging gear and second engaging gear within the void space defined by the first guide wall inner surface and second guide wall inner surface. In the assembled container, the sleeve slot mates with a set of guides (33, 34) such that the first sleeve slot wall of each sleeve is juxtaposed with the first guide wall outer surface 35*b* of a particular guide and the second sleeve slot wall of each sleeve is juxtaposed with the second guide wall outer surface 36*b* of a particular guide.

Figure 4:
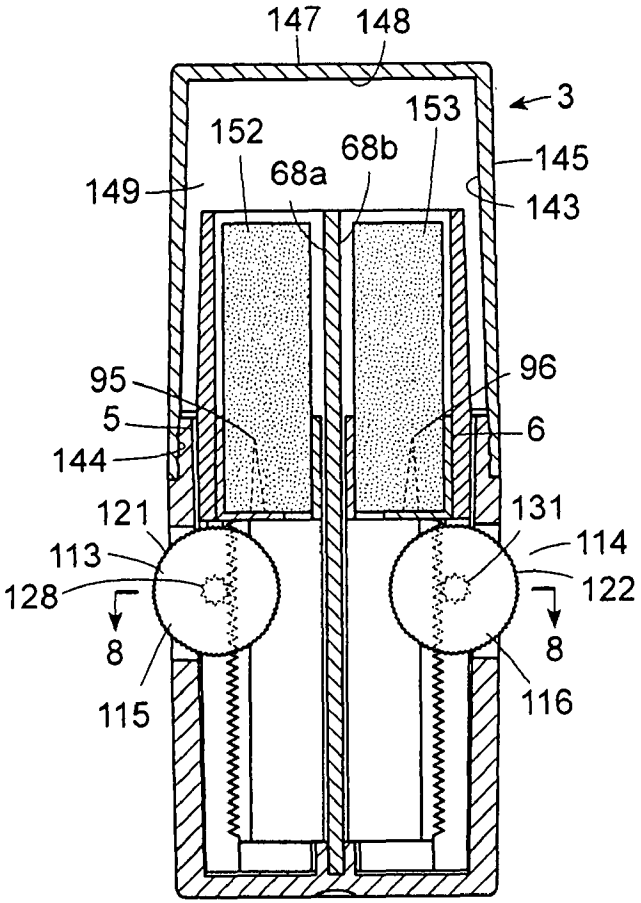
FIG. 4 is a cross section along line 44 of FIG. 1 showing the internal features of a container with product sticks recessed within a sleeve in accordance with an embodiment of the invention.
Figure 6:
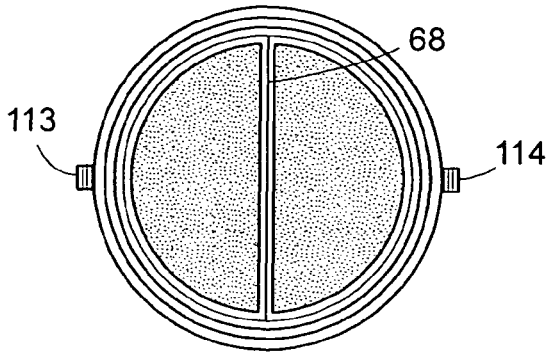
FIG. 6 is a top view of the container in accordance with an embodiment of the invention having two product sticks.

Referring to FIGS. 2- 4, the cover 2 comprises a cover bottom 141 a cover side wall 142 having a cover side wall inner surface 143 and a cover side wall outer surface 145 and a cover top 146 having a cover top outer surface 147 and a cover top inner surface 148. The cover side wall inner surface 143 and cover top inner surface 148 define a cover annular space 149. The cover bottom is open and thus comprises a cover bottom opening 150 which is defined by the cover sidewall inner surface 143 at the cover bottom 141. The cover sidewall inner surface may, as shown in FIG. 4, comprise a recessed area 144 proximate to the cover bottom which mates with the collar 30 of the body to hold the cover and body together when the cover and body are engaged. The collar and/or recessed area may further comprise means for releasably securing the cover to the body, such as, as shown in FIG. 5, one or more rim protrusions 154 which extend around the outer surface of the collar. The inner surface of the recessed area of the cover may also have protrusions or rims in addition to or in place of those on the collar. The invention pertains to any means capable of holding the cover in fixed relationship engaged with the body and includes such means for releasably securing the cover to the body as bump protrusions on the recessed area and/or collar, screw threads on the recessed area and collar, buttons and dimples on the recessed area and/or collar, hook and loop type materials on the recessed area and collar and the like.

In use, a consumer removes the cover from the body and then selects the product stick to be applied. The consumer then rotates the wheel in one direction to project the elevator platform and thus propel the product stick from the sleeve for application. When finished, the wheel can be rotated in the opposite direction to retract the elevator platform and product stick back into the sleeve. Because each elevator platform operates independently, more than one type or color of product stick can be held within the container, for example, when the cosmetic stick is a lipstick different color sticks can be held in the container, as well as different types of materials, such as combinations of some or all of lip sticks, lip balm, eyeliner and facial cosmetics, such as mascara.

What is claimed is:

1. A container for holding one or more product sticks comprising:

a) a body having an upper end with a rim that defines an upper opening, a bottom having a bottom inner surface and a bottom outer surface, a side wall which extends from the upper opening to the bottom having a side wall inner surface and a side wall outer surface with the side wall inner surface and bottom inner surface defining a body annular space and one or more wheel slots defined by wheel slot walls;

b) a sleeve having a sleeve top, a sleeve bottom and a sleeve side wall having a sleeve inner surface defining a sleeve annular space and a sleeve outer surface the sleeve further comprising one or more sleeve slots in the sleeve side wall each extending from the sleeve bottom to a point between the sleeve top and sleeve bottom each defined by a sleeve slot first wall, sleeve slot second wall and sleeve slot top wall which extends from the sleeve slot first wall to the sleeve slot second wall, and wherein the sleeve further comprises one or more brake slots each brake slot having a brake slot first side wall, a brake slot second side wall and a brake slot top and a brake slot bottom, and wherein each brake slot comprises a brake slot first protrusion and a brake slot second protrusion both proximate to the brake slot bottom and a brake slot third protrusion proximate to the brake slot top; and c) one or more lifting means comprising i) one or more elevator platforms each having an elevator platform top, an elevator platform bottom, an external wall having a distal side wall and a forward side wall and an external wall inner surface and an external wall outer surface the external wall extending from the elevator platform top to the elevator platform bottom and an internal wall which extends from the forward side wall of the external wall to the distal side wall of the external wall, the internal wall having an internal wall inner surface and an internal wall outer surface and a cup defined by the internal inner surface and at least part of the external wall inner surface, wherein each elevator platform comprises a forward brake which extends from the external wall outer surface at the forward side wall proximate to the elevator platform bottom and a distal brake which extends from the external wall outer surface at the distal side wall proximate to the elevator platform bottom;

ii) one or more platform slots within the external wall of the elevator platform which extends from the elevator platform bottom to a point between the elevator platform bottom and the elevator platform top each platform slot defined by a platform slot forward edge, platform slot distal edge and platform slot top;

iii) a forward teeth member which extends from the platform slot forward edge partially into the platform slot and a distal teeth member which extends from the platform slot distal edge partially into the platform slot wherein the forward teeth member and distal teeth member comprise a plurality of teeth; and iv) one or more wheels each comprising a wheel body having a wheel body first surface and a wheel body second surface with a continuous perimeter, a first axle and a second axle and a first engaging gear and a second engaging gear wherein the first engaging gear extends laterally from the wheel body first surface and the first engaging gear has a first engaging gear outer surface and first engaging gear continuous side surface which comprises a plurality of first engaging gear teeth and the second engaging gear extends laterally from the wheel body second surface and the second engaging gear has a second engaging gear outer surface and second engaging gear continuous side surface which comprises a plurality of second engaging gear teeth wherein the first engaging gear teeth or second engaging gear teeth are engaged with teeth of the forward teeth member or the distal teeth member such that movement of a wheel causes an elevator platform to move.

2. The container of claim 1 having a first wheel and a second wheel and a first elevator platform and a second elevator platform and the movement of the first wheel causes the first elevator platform to move independent of the second elevator platform and movement of the second wheel causes the second elevator platform to move independent of the first elevator platform.

3. The container of claim 2 further comprising a first product stick in the cup of the first elevator platform and a second product stick in the cup of the second elevator platform.

4. The container of claim 1 further comprising a collar at the upper end of the body.

5. The container of claim 4 further comprising a cover having a cover bottom, a cover side wall having a cover side wall inner surface and a cover side wall outer surface and a cover top having a cover top outer surface and a cover top inner surface and a cover annular space defined by the cover side wall inner surface and cover top inner surface wherein the cover side wall inner surface comprises a recessed area proximate to the cover body and the recessed area or collar comprises a means for releasably securing the cover to the body.

6. The container of claim 1 wherein the body further comprises one or more sets of guides with each set of guides comprising a first guide wall having an apex with an apex surface, a base, a first guide wall inner surface, a first guide wall outer surface and a first guide wall end surface and a second guide wall having an apex with an apex surface, a base, a second guide wall inner surface, a second guide wall outer surface and a second guide wall end surface.

7. The container of claim 6 wherein the first guide wall and second guide wall each comprise means for holding the wheel.

8. The container of claim 7 wherein the means for holding the wheel comprises a notch at the apex surfaces of the first guide wall and the second guide wall wherein each apex surface comprises a distal apex surface proximate to the inner surface of the side wall of the body and a forward apex surface proximate to the guide wall end surface and the notch is between the distal apex surface and forward apex surface and is defined by a forward notch wall which extends about perpendicular from the forward apex surface, a distal notch wall which extends about perpendicular from the distal apex surface and a notch base wall which extends from the forward notch wall to the distal notch wall and the first axle is within the notch of the first guide wall and second axle is within the notch of the second guide wall.

9. The container of claim 8 wherein the first axle of each wheel extends from the first engaging gear outer surface at about the center of the first engaging gear outer surface and comprises a first axle end and a first axle side surface, with the first axle being in the shape of a cylinder, and the second axle extends from the second engaging gear outer surface at about the center of the second engaging gear outer surface and comprises a second axle end and a second axle side surface, with the second axle being in the shape of a cylinder.

10. The container of claim 6 wherein the body comprises one or more elevator platform stops at the bottom inner surface.

11. The container of claim 10 wherein the elevator platform stops comprise a first crescent element extending from the outer surface of the first guide wall to a first end point and a second crescent element extending from the outer surface of the second guide wall to a second end point opposite to the first end point with a joining member that extends from the first end point to the second end point.

12. The container of claim 1 wherein the sleeve further comprises one or more dividing walls.

13. The container of claim 12 comprising one dividing wall which extends from the sleeve top to the sleeve bottom and separates the sleeve annular space into a first compartment and a second compartment.

14. The container of claim 1 wherein the continuous perimeter comprises a plurality a crevices.

15. The container of claim 1 further comprising a cover having a cover bottom, a cover side wall having a cover side wall inner surface and a cover side wall outer surface and a cover top having a cover top outer surface and a cover top inner surface and a cover annular space defined by the cover side wall inner surface and cover top inner surface.

16. The container of claim 1 further comprising one or more product sticks.

17. The container of claim 16 wherein the product stick is selected from the group consisting of lipstick, lip balm, eye liner, facial cosmetic and combinations thereof.

* * * * *